US010309067B2

(12) United States Patent
Sondreal

(10) Patent No.: US 10,309,067 B2
(45) Date of Patent: Jun. 4, 2019

(54) ROTOR DEPLOYMENT MECHANISM FOR A MACHINE

(71) Applicant: Caterpillar Paving Products Inc., Brooklyn Park, MN (US)

(72) Inventor: Dustin W. Sondreal, Hanover, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/797,983

(22) Filed: Oct. 30, 2017

(65) Prior Publication Data

US 2019/0127930 A1 May 2, 2019

(51) Int. Cl.

| | |
|---|---|
| ***E01C 23/088*** | (2006.01) |
| ***E01C 23/12*** | (2006.01) |
| ***F15B 15/06*** | (2006.01) |
| ***E02F 3/18*** | (2006.01) |

(52) U.S. Cl.
CPC ..... *E01C 23/127* (2013.01); *E02F 3/188* (2013.01); *F15B 15/06* (2013.01)

(58) Field of Classification Search
CPC ..... E01C 21/00; E01C 23/06; E01C 23/088; E01C 23/127; E02F 3/20; E02F 3/188; E02F 9/2271
See application file for complete search history.

(56) References Cited

U.S. PATENT DOCUMENTS

| | | | | |
|---|---|---|---|---|
| 3,746,101 | A * | 7/1973 | Takata | E02F 3/783 172/112 |
| 3,888,542 | A * | 6/1975 | Gowler | B60K 17/10 299/1.5 |
| 4,786,111 | A * | 11/1988 | Yargici | B28D 1/188 299/10 |
| 5,287,933 | A * | 2/1994 | Lindblom | E02F 3/188 172/112 |
| 9,068,304 | B2 | 6/2015 | Mannebach et al. | |
| 2016/0326701 | A1* | 11/2016 | Schlenker | E01C 19/004 |

* cited by examiner

*Primary Examiner* — Carib A Oquendo
(74) *Attorney, Agent, or Firm* — Bookoff McAndrews

(57) ABSTRACT

A machine having a ground-engaging rotor may include a first swing arm and a second swing arm. A first end of the first swing arm may be pivotably coupled a frame of the machine at a first pivot and its second end may be coupled to the rotor. A third end of the second swing arm may be pivotably coupled the frame at a second pivot and its fourth end may be coupled to the rotor. A torsion bar and a crossbeam may both be coupled to the first swing arm and the second swing arm. At least one actuator may also be coupled to the crossbeam such that activation of the at least one actuator rotates the first swing arm about the first pivot, and the second swing arm about the second pivot, and deploy the rotor.

20 Claims, 2 Drawing Sheets

ROTOR DEPLOYMENT MECHANISM FOR A MACHINE

TECHNICAL FIELD

The present disclosure relates generally to a road construction machine, and more particularly, to the rotor deployment mechanism for the machine.

BACKGROUND

Roadways are built to facilitate vehicular travel. Depending upon usage density, base conditions, temperature variation, moisture levels, and/or physical age, the surfaces of the roadways eventually become misshapen and unable to support wheel loads. In order to rehabilitate the roadways for continued vehicular use, road construction machines are used to remove the spent road surface in preparation for resurfacing. In some cases, the removed layer is pulverized, mixed with other material (such as binders and emulsions), and spread back on the roadway to stabilize the deteriorated roadway. In some cases, removed layer is mixed with additives and spread on the roadway. Some road construction machines, such as, for example, cold planers, reclaimers, etc., include a rotating rotor with cutting tools that can be lowered on to (i.e., deployed on) the road surface to break up the surface layer. For smooth operation of the machine, it is desirable to support the rotor on the machine in a stable manner.

U.S. Pat. No. 9,068,304, issued to Mannebach et al. on Jul. 30, 2015 ("the '304 patent"), describes connecting the cutting rotor of a reclaimer to the machine frame using pivoted two-armed levers positioned on either side the rotor. The rotor mounting mechanism of the '304 patent may not provide sufficient stability for some applications. The rotor deployment mechanism of the present disclosure may solve one or more of the problems set forth above and/or other problems in the art. The scope of the current disclosure, however, is defined by the attached claims, and not by the ability to solve any specific problem.

SUMMARY

In one aspect, a machine having a ground-engaging rotor is disclosed. The machine may include a first swing arm having a first end and a second end opposite the first end, and a second swing arm having a third end and a fourth end opposite the third end. The first end of the first swing arm may be pivotably coupled a frame of the machine at a first pivot and the second end may be coupled to the rotor. The third end of the second swing arm may be pivotably coupled the frame at a second pivot and the fourth end may be coupled to the rotor. A torsion bar and a crossbeam may be coupled to both the first swing arm and the second swing arm. At least one actuator may be coupled to the crossbeam such that activation of the at least one actuator rotates the first swing arm about the first pivot and the second swing arm about the second pivot and deploy the rotor.

In another aspect, a method of operating a machine having a ground-engaging rotor is disclosed. The method includes activating a rotation of the rotor positioned between a first swing arm and a second swing arm. The first swing arm may include a first end and a second end opposite the first end, and the second swing arm may include a third end and a fourth end opposite the third end. The first end of the first swing arm may be pivotably coupled a frame of the machine at a first pivot and the second end may be coupled to the rotor. The third end of the second swing arm may be pivotably coupled the frame at a second pivot and the fourth end may be coupled to the rotor. A torsion bar may be coupled to both the first swing arm and the second swing arm. And, a crossbeam may be coupled to both the first swing arm and the second swing arm. The method may include activating at least one actuator coupled to the crossbeam to rotate the first swing arm about the first pivot and the second swing arm about the second pivot and deploy the rotor.

In yet another aspect, a machine having a ground-engaging rotor is disclosed. The machine may include a first swing arm and a second swing arm symmetrically positioned about a longitudinal axis of the machine. The first swing arm may include a first end and a second end opposite the first end. The first end may be pivotably coupled a frame of the machine at a first pivot and the second end may be coupled to the rotor. The second swing arm may include a third end and a fourth end opposite the third end. The third end may be pivotably coupled the frame at a second pivot and the fourth end may be coupled to the rotor. A torsion bar may extend substantially transverse to the longitudinal axis and may be coupled to the first swing arm at the second end and may be coupled to the second swing arm at the fourth end. A crossbeam may extend substantially transverse to the longitudinal axis and may be coupled to the first swing arm at a location between the first end and the second end and may be coupled to the second swing arm at a location between the third end and the fourth end. At least one actuator may be coupled to the crossbeam such that activation of the at least one actuator synchronously rotates the first swing arm about the first pivot and the second swing arm about the second pivot to move the rotor with respect to the frame of the machine.

DETAILED DESCRIPTION

For the purpose of this disclosure, the term "ground surface" is broadly used to refer to all types of surfaces that form typical roadways (e.g., asphalt, cement, clay, sand, dirt, etc.) or can be conditioned to form roadways. In this disclosure, relative terms, such as, for example, "about" is used to indicate a possible variation of ±10% in a stated numeric value. Although the current disclosure is described with reference to a machine which performs surface reclamation and stabilization, this is only exemplary. In general, the current disclosure can be applied as a rotor deployment mechanism of any machine, such as, for example, a cold planer or another milling machine.

Figure 1:
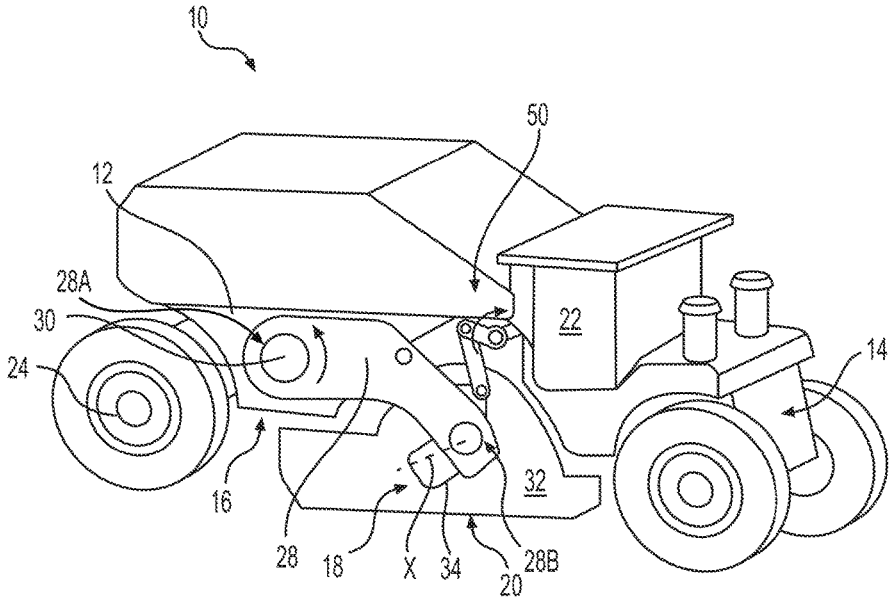
FIG. 1 is an illustration of one configuration of an exemplary reclaimer.
Figure 2:
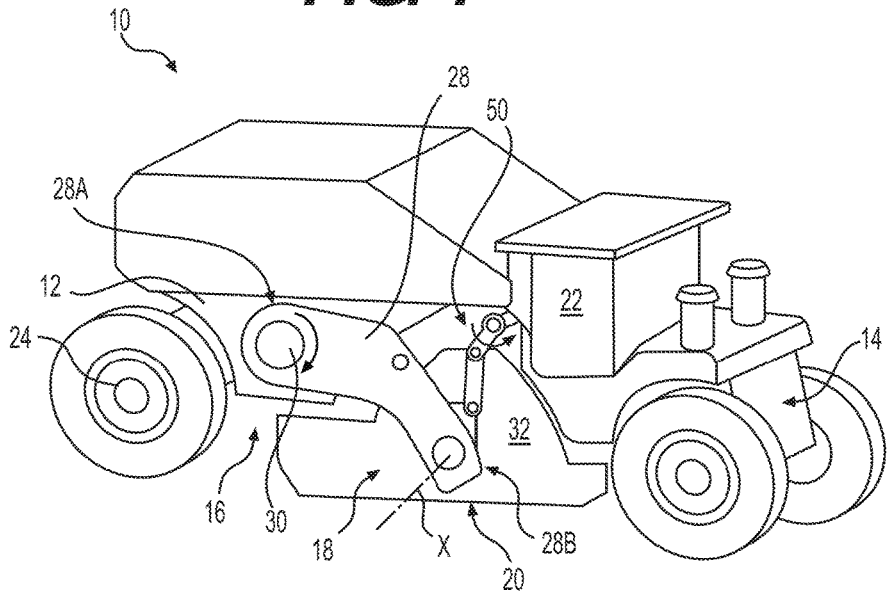
FIG. 2 is an illustration of another configuration of the reclaimer of FIG. 1.

FIGS. 1 and 2 illustrate a simplified perspective view of an exemplary reclaimer machine 10 according to the present disclosure. For sake of brevity, the reclaimer machine 10 is referred to as the machine 10 for the remainder of this document. FIG. 1 illustrates view of machine 10 with its rotor in the retracted configuration, and FIG. 2 illustrates a view of machine 10 with its rotor in the deployed configuration. In the discussion below, reference will be made to both FIGS. 1 and 2. The machine 10 is built upon a frame 12 and includes, among other systems, a power system 14, a propulsion system 16, a rotor assembly 18, and an operator station 22. The machine frame 12 is generally a rigid metal frame (e.g., iron, steel, etc.) configured to support the machine 10 and to withstand the forces and vibrations when the rotor assembly 18 engages with and operates on a ground surface. The frame 12 supports the power system 14 (and related systems such as a cooling system) and the operator station 22. The power system 14 is operatively connected to the drive wheels 24 located on opposite sides of machine 10 via components of the propulsion system 16 (e.g., transmission, hydraulic pump, hydraulic motors, etc.).

Power system 14 includes a power generation mechanism that provides power to propel and operate the machine 10. In some embodiments, the power system 14 may include an internal combustion reciprocating engine such as a diesel engine, a gasoline engine, a gaseous fuel (e.g., a natural gas) powered engine, an electric drive. To propel the machine 10, the propulsion system 16 may include a hydraulic, mechanical, or an electric drive that transmits the power generated by the power system 14 to the drive wheels 24. In some embodiments, the power system 14 may be operatively connected to a hydraulic pump (such as, for example, a variable or fixed displacement hydraulic pump) that produces and directs a stream of pressurized fluid to one or more motors associated with the wheels 24 for propulsion of the machine 10. Alternatively, the power system 14 may be operatively connected to an alternator or generator configured to produce an electrical current used to power one or more electric motors driving the wheels 24. The power system 14 may be operatively coupled with the wheels 24 through components of a mechanical transmission (torque converter, gear box, differential, reduction gear arrangement, etc.)

In addition to providing power to propel the machine 10, the power system 14 may also be configured to supply power to the rotor assembly 18. The rotor assembly 18 may include, among other components, a rotor 20 positioned in a rotor chamber 32. The rotor 20 (partially visible in FIG. 3) is a cylindrical drum-like component extending along the width of machine 10, and having cutting features (cutting bits, teeth, etc.) on its outer cylindrical surface. The power system 14 may be operatively coupled to the rotor 20 through mechanical (e.g., chains, belts, pulleys, etc.) and/or hydraulic components (e.g., pumps, hydraulic cylinders, valves, supply lines, etc.) to rotate the rotor 20 about an axis "X" that extends across the width of machine 10. During operation of machine 10, when the rotor 20 is deployed in the ground surface, the rotating rotor 20 engages with the ground to break up the ground surface. It should be noted that the description of the rotor 20 above is only exemplary. In general, the rotor 20 may be of any form that is configured to perform a desired operation on the ground surface.

Figure 3:
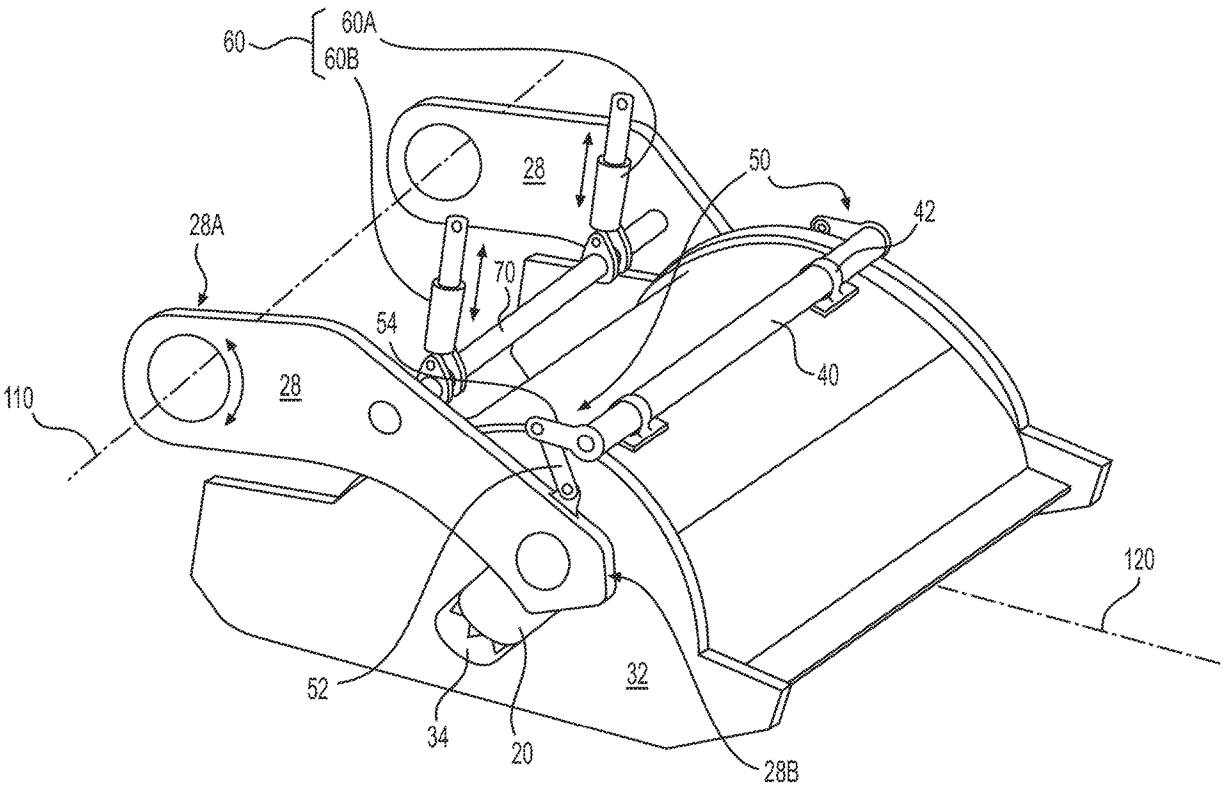
FIG. 3 is an illustration of a portion of the reclaimer of FIG. 1.

The rotor 20 is rotatably mounted within the rotor chamber 32, and is supported by left and right swing arms 28 of the machine 10. FIG. 3 is a schematic view of the machine 10 with some components removed to illustrate the swing arms 28. In the discussion below, reference will be made to FIGS. 1-3. The right and left swing arms 28 are located on either side of the machine 10, and are symmetrically positioned about a longitudinal axis 120 that extends along the length of the machine 10. Both the right and the left swing arms 28 have the same configuration and function substantially similarly. Therefore, in the discussion below, only one of the swing arms 28 will be described.

A first end 28A of each swing arm 28 is pivotably coupled to the machine frame 12 at a pivot 30 (see FIGS. 1 and 2), and the opposite second end 28B (of the swing arm 28) is coupled to the rotor 20 via a rotor connection housing extending through a cutout 34 in the rotor chamber 32 (see FIG. 3). Typically, the cutout 34 is covered by a debris plate (not shown) that enables movement of rotor 20 along the cutout 34 while minimizing escape of debris. The second end 28B of each swing arm 28 is also connected to, and supported by, a common torsion bar 40 through a link assembly 50. As shown in FIG. 3, the torsion bar 40 is an elongate bar or rod that extends across the width of the machine 10 substantially transverse to the longitudinal axis 120 of the machine 10. In some embodiments, the torsion bar 40 may be rotatably mounted to (or attached to) the rotor chamber 32 via mounts 42. In some embodiments, the mounts 42 may include bearings to facilitate the rotation of the torsion bar 40 in the mounts 42. Although two mounts 42 are illustrated in FIG. 3, in general, any number (1, 3, 4, etc.) may couple the torsion bar 40 to the rotor chamber 32.

The link assembly 50 may include a first link 52 and a second link 54 pivotably coupled to each other at one of their ends. The opposite end of the first link 52 is pivotably coupled to the second end 28B of the swing arm 28. And, the opposite end of the second link 54 is fixedly coupled to the torsion bar 40 such that, when the torsion bar 40 rotates (in the mounts 42), the second links 54 on either side of the torsion bar 40 rotates along with it jointly. That is, there is no relative motion between the second links 54 on either side of the torsion bar 40. It should be noted that the structure of the described link assembly 50 is only exemplary. As would be recognized by people skilled in the art, link assembly 50 may have any number of links and may have any structure that is suited for its function (described below).

Rotating the swing arms 28 at the pivot 30 about axis 110 moves the rotor 20 between its deployed configuration (i.e., when the rotor 20 is engaged with the ground surface) and its retracted configuration (i.e., when the rotor 20 is off the ground surface). When the first end 28A of the swing arm 28 is rotated about the pivot 30 in the clockwise direction (see FIG. 2), its second end 28B swings towards the ground surface, and the rotor 20 moves from its retracted configuration (FIG. 1) to its deployed configuration (FIG. 2). With reference to FIG. 3, when the swing arm 28 rotates clockwise, the torsion bar 40 along with the second links 54 on either side of the torsion bar 40 rotates jointly in the counter-clockwise direction. As each second link 54 rotates in the counter-clockwise direction, the first link 52 pivoted to each second link 54 rotates about its pivot point to extend the link assembly 50 and allow the second end 28B (of the swing arm 28) to move away from the torsion bar 40 and towards the ground surface. In a similar manner, rotating the first end 28A of the swing arm 28 in the counter-clockwise direction (see FIG. 1) lifts the rotor 20 from its deployed to its retracted configuration. When the swing arm 28 rotates counter-clockwise, the link assembly 50 rotates about its pivot points to allow the rotor 20 to move towards the torsion bar 40 in a synchronous manner.

Supporting the second ends 28B of the two swing arms 28 using the common torsion bar 40 enables each swing arm 28 to move towards and away from the ground surface in a synchronous and controlled manner. In general, the torsion bar 40 can have any size and shape. Although not a requirement, in some embodiments, the torsion bar 40 may have a circular cross-sectional shape and have a diameter between about 7-10 inches.

In general, any known device and technique may be used to actuate the swing arms 28 (i.e., rotate the swing arms 28 about the pivot 30) and move the rotor 20 between its retracted and deployed configurations. In some embodiments, an actuator system 60 may be used to actuate the swing arms 28. As illustrated in FIG. 3, the actuator system 60 may include at least one actuator, such as, for example, or a pair (or a different number) of hydraulic cylinders 60A, 60B connected at one end to a crossbeam 70 that couples the two swing arms 28 together, and at another end to the frame 12 of the machine 10. The crossbeam 70 may include a rod or a beam that extends substantially transverse to the longitudinal axis 120 of the machine 10 (i.e. substantially parallel to axis 110). The crossbeam 70 may connect the two swing arms 28 at a location between the first and second ends 28A, 28B of the swing arms 28. When the pair of hydraulic cylinders 60A, 60B extend, the crossbeam 70 simultaneously pushes the left and right swing arms 28 in a downward direction, causing both the swing arms 28 to rotate synchronously about the pivot 30 in a clockwise direction (in the view illustrated in FIG. 3) and deploy the rotor 20. Similarly, when the pair of hydraulic cylinders 60A, 60B retract, the crossbeam 70 forces the swing arms 28 to rotate about the pivot 30 in the opposite direction and move the rotor 20 to its retracted configuration. Although an actuator system 60 with two hydraulic cylinders are illustrated in FIG. 3, this is only exemplary. In general, any known type of actuator may be used in actuation system 60.

As illustrated in FIG. 3, in some embodiments, the swing arms 28, the link assemblies 50, the actuation mechanism 60, the torsion bar 40, and the crossbeam 70 may be substantially symmetrically positioned about the longitudinal axis 120 that extends along a length of the machine 10. Further, in some embodiments, the link assemblies 50, the actuation mechanism 60, the torsion bar 40, and the crossbeam 70 may be substantially positioned between the two swing arms 28.

INDUSTRIAL APPLICABILITY

The disclosed rotor deployment mechanism may be used in any machine where stable operation of the machine rotor is important. The disclosed rotor deployment mechanism may include a pair of symmetric swing arms attached to the rotor to actuate the rotor to its deployed configuration. The two swing arms may be coupled together using a torsion bar and a crossbeam to enable the swing arms to move in a synchronous manner during actuation. Operation of machine 10 will now be explained.

During operation of machine 10, the rotor 20 may remove a portion of the ground surface below the rotor 20 as it traverses along the ground surface. In some cases, several passes or "cuts" may be made in order to completely treat the ground surface. During each pass, the rotor 20 may cut the ground surface at a desired depth. To begin a cut as the machine 10 traverses the ground surface, the operator of the machine may actuate the rotor 20 (e.g., to begin rotation) and may activate an actuator system 60 (e.g., using a control system), such as the pair of hydraulic cylinders 60A, 60B, to deploy the rotating rotor 20 onto the ground surface. When activated, the hydraulic cylinders 60A, 60B may push down on a crossbeam 70 that connects the left and the right swing arm 28 and cause the swing arms 28 to rotate (in a clockwise direction in FIG. 3) in a synchronous manner about the pivot 30. Rotation of the swing arms 28 moves the rotor 20 to its deployed configuration (FIG. 2) where it engages with, and operates on, the ground surface. A common torsion bar 40 that couples to, and supports, the two swing arms 28 proximate to the rotor 20 assists in parallel engagement of the rotor 20 with the ground surface.

The use of the crossbeam 70 (i.e., coupling the pair of hydraulic cylinders 60A, 60B to a crossbeam that is connected to both the swing arms 28) to actuate (i.e., deploy and retract) the rotor 20, forces the two swing arms 28 to move synchronously. Supporting the second ends 28B of the two swing arms 28 to the common torsion bar 40 (through the link assemblies 50) also allows the second ends 28B of each swing arm 28 to move towards the ground surface in a synchronous and controlled manner. The synchronous movement of the swing arms 28 towards the ground surface causes the rotor 20 to engage with the ground surface in a parallel manner and improve the operation of the machine 10. Coupling the two swing arms 28 together using the crossbeam 70 and the torsion bar 40 also increases the stability of the machine 10 (e.g., when the machine 10 operates on the ground surface) and assist in generating a level and stable cut.

It will be apparent to those skilled in the art that various modifications and variations can be made to the disclosed system without departing from the scope of the disclosure. Other embodiments of the system will be apparent to those skilled in the art from consideration of the specification and practice of the rotor deployment mechanism disclosed herein. It is intended that the specification and examples be considered as exemplary only, with a true scope of the disclosure being indicated by the following claims and their equivalents.

What is claimed is:

1. A machine having a ground-engaging rotor, comprising:

a first swing arm having a first end and a second end opposite the first end, the first end being pivotably coupled a frame of the machine at a first pivot and the second end being coupled to the rotor;

a second swing arm having a third end and a fourth end opposite the third end, the third end being pivotably coupled the frame at a second pivot and the fourth end being coupled to the rotor;

a torsion bar coupled to both the first swing arm and the second swing arm and configured to rotate in a direction opposite to the first swing arm and the second swing arm;

a crossbeam directly coupled to both the first swing arm and the second swing arm; and at least one actuator directly coupled to the crossbeam such that activation of the at least one actuator rotates the first swing arm about the first pivot and the second swing arm about the second pivot and deploys the rotor.

2. The machine of claim 1, wherein the torsion bar couples the second end of the first swing arm to the fourth end of the second swing arm.

3. The machine of claim 2, further including a first link assembly that couples the second end of the first swing arm to one end of the torsion bar and a second link assembly that couples an opposite end of the torsion bar to the fourth end of the second swing arm.

4. The machine of claim 3, wherein the first link assembly and the second link assembly each include at least two links pivotably coupled to each other such that rotation of the first swing arm and the second swing arm in a first direction causes the torsion bar and one link of each of the first link assembly and the second link assembly to rotate in a second direction opposite to the first direction.

5. The machine of claim 1, wherein the crossbeam is coupled to a location of the first swing arm positioned between the first end and the second end and coupled to a location of the second swing arm positioned between the third end and the fourth end.

6. The machine of claim 1, wherein the at least one actuator includes at least a pair of hydraulic actuators.

7. The machine of claim 1, wherein the crossbeam and the torsion bar are positioned such that activation of the at least one actuator moves the second end of the first swing arm and the fourth end of the second swing arm synchronously.

8. The machine of claim 1, wherein the first swing arm and the second swing arm are positioned symmetrically about a longitudinal axis of the machine.

9. The machine of claim 1, wherein activation of the at least one actuator moves the rotor with respect to the torsion bar.

10. The machine of claim 1, wherein the rotor is positioned in a rotor chamber, and wherein activation of the at least one actuator moves the rotor vertically with respect to the rotor chamber.

11. The machine of claim 1, wherein the second end of the first swing arm is coupled to one end of the rotor and the fourth end of the second swing arm is coupled to an opposite end of the rotor.

12. A method of operating a machine having a ground-engaging rotor, comprising:

activating a rotation of the rotor positioned between a first swing arm and a second swing arm, wherein the first swing arm includes a first end and a second end opposite the first end, and the second swing arm includes a third end and a fourth end opposite the third end, and wherein (a) the first end of the first swing arm is pivotably coupled to a frame of the machine at a first pivot and the second end is coupled to the rotor, (b) the third end of the second swing arm is pivotably coupled to the frame at a second pivot and the fourth end is coupled to the rotor, (c) a torsion bar is coupled to both the first swing arm and the second swing arm and is configured to rotate in a direction opposite to the first swing arm and the second swing arm, and (d) a crossbeam is coupled to both the first swing arm and the second swing arm; and activating at least two actuators coupled to the crossbeam to rotate the first swing arm about the first pivot and the second swing arm about the second pivot and deploy the rotor.

13. The method of claim 12, wherein the crossbeam and the torsion bar are positioned such that activation of the at least two actuators moves the second end of the first swing arm and the fourth end of the second swing arm synchronously.

14. The method of claim 12, further including a first link assembly coupling the second end of the first swing arm to one end of the torsion bar, wherein activating the at least one actuator includes rotating the first swing arm about the first pivot in a first direction, and wherein activating the at least two actuators includes rotating a link of the first link assembly and the torsion bar in a second direction opposite to the first direction.

15. A machine having a ground-engaging rotor, comprising:

a first swing arm and a second swing arm symmetrically positioned about a longitudinal axis of the machine, wherein (a) the first swing arm includes a first end and a second end opposite the first end, the first end being pivotably coupled to a frame of the machine at a first pivot and the second end being coupled to the rotor, and (b) the second swing arm includes a third end and a fourth end opposite the third end, the third end being pivotably coupled to the frame at a second pivot and the fourth end being coupled to the rotor;

a torsion bar extending substantially transverse to the longitudinal axis and coupled to the first swing arm at the second end and coupled to the second swing arm at the fourth end;

a crossbeam extending substantially transverse to the longitudinal axis and coupled to the first swing arm at a location between the first end and the second end and coupled to the second swing arm at a location between the third end and the fourth end; and at least one actuator coupled to the crossbeam such that activation of the at least one actuator synchronously rotates the first swing arm about the first pivot and the second swing arm about the second pivot to move the rotor with respect to the frame of the machine, wherein rotation of the first swing arm and the second swing arm in a first direction rotates the torsion bar in a second direction opposite to the first direction.

16. The machine of claim 15, further including a first link assembly that couples the second end of the first swing arm to one end of the torsion bar, and a second link assembly that couples an opposite end of the torsion bar to the fourth end of the second swing arm, wherein the first link assembly and the second link assembly each include at least two links pivotably coupled to each other, and wherein rotation of the first swing arm and the second swing arm in the first direction rotates a portion of each of the first link assembly and the second link assembly in the second direction.

17. The machine of claim 15, wherein the at least one actuator includes a pair of hydraulic actuators.

18. The machine of claim 15, wherein the rotor is positioned in a rotor chamber, and the torsion bar is rotatably mounted to the rotor chamber.

19. The machine of claim 18, wherein activation of the at least one actuator moves the rotor with respect to the rotor chamber.

20. The machine of claim 15, wherein the second end of the first swing arm is coupled to one end of the rotor and the fourth end of the second swing arm is coupled to an opposite end of the rotor.

* * * * *